US007772757B2

(12) United States Patent
Kane et al.

(10) Patent No.: US 7,772,757 B2
(45) Date of Patent: Aug. 10, 2010

(54) WHITE-LIGHT ELECTRO-LUMINESCENT DEVICE WITH IMPROVED EFFICIENCY

(75) Inventors: Paul J. Kane, Rochester, NY (US); Michael E. Miller, Honeoye Falls, NY (US); Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 490 days.

(21) Appl. No.: 11/755,037

(22) Filed: May 30, 2007

(65) Prior Publication Data

US 2008/0297028 A1 Dec. 4, 2008

(51) Int. Cl.
*H01J 1/62* (2006.01)
*H01J 63/04* (2006.01)

(52) U.S. Cl. ..... 313/498; 313/483; 313/499; 313/500; 313/501; 313/502; 313/503; 313/504; 313/505; 313/506

(58) Field of Classification Search ..... None
See application file for complete search history.

(56) References Cited

U.S. PATENT DOCUMENTS

| | | | | |
|---|---|---|---|---|
| 6,693,611 | B1 * | 2/2004 | Burroughes | 345/83 |
| 6,841,949 | B2 | 1/2005 | Duggal | |
| 7,012,588 | B2 * | 3/2006 | Siwinski | 345/83 |
| 7,122,842 | B2 | 10/2006 | Hill | |
| 2004/0264193 | A1 | 12/2004 | Okumura | |
| 2005/0194608 | A1 | 9/2005 | Chen | |
| 2005/0212728 | A1 * | 9/2005 | Miller et al. | 345/76 |
| 2006/0043361 | A1 | 3/2006 | Lee et al. | |
| 2006/0105198 | A1 * | 5/2006 | Spindler et al. | 428/690 |

OTHER PUBLICATIONS

"Quantum Dot Light Emitting Devices for Pixelated Full Color Displays" by Bulovic and Bawendi, Society for Information Display Conference, 2006.

"From Visible to White Light Emission by GaN Quantum Dots on Si(111) Substrate," by Damilano et al., Applied Physics Letters, vol. 75, No. 7, p. 962, Aug. 1999.

* cited by examiner

*Primary Examiner*—Nimeshkumar D Patel
*Assistant Examiner*—Natalie K Walford
(74) *Attorney, Agent, or Firm*—Stephen H. Shaw; Raymond L. Owens

(57) ABSTRACT

A white-light electroluminescent device having an adjustable color temperature substantially on a predetermined range of a Planckian locus within the 1976 Commission Internationale de l'Eclairage (CIE) uniform chromaticity scale diagram. According to one embodiment, a first light-emitting element having a fixed ratio of at least two different species of emitters combined to produce a set of chromaticity coordinates at a predetermined white point substantially on the Planckian locus. A second light-emitting element having at least a single species of emitters produces a set of chromaticity coordinates. The set of chromaticity coordinates are positioned along a projected line extending from the Planckian locus and through the chromaticity coordinates of the first light-emitting layer. A controller adjusts the voltage or current associated with the first and second light-emitting elements to provide white light with a predetermined range of chromaticity coordinates substantially on the Planckian locus.

8 Claims, 10 Drawing Sheets

(b)

(a)

WHITE-LIGHT ELECTRO-LUMINESCENT DEVICE WITH IMPROVED EFFICIENCY

FIELD OF THE INVENTION

The present invention relates to inorganic LED devices employing quantum dot light-emitting layers. Specifically, the invention relates to inorganic white-light LED devices employing quantum dot white light-emitting layers, capable of producing a multiplicity of colors of white light that approximate blackbody or daylight whites, using two emitters.

BACKGROUND OF THE INVENTION

In recent years, light-emitting devices have included quantum-dot emitting layers to form large area light emission. One of the predominant attributes of this technology is the ability to control the wavelength of emission, simply by controlling the size of the quantum dot. As such, this technology provides the opportunity to relatively easily design and synthesize the emissive layer in these devices to provide any desired dominant wavelength, as well as control the spectral breadth of emission peaks. This fact has been discussed in a paper by Bulovic and Bawendi, entitled "Quantum Dot Light Emitting Devices for Pixelated Full Color Displays" and published in the proceedings of the 2006 Society for Information Display Conference. As discussed in this paper, differently sized quantum dots may be formed and each differently-sized quantum dot will emit light at a different dominant wavelength. This ability to tune light emission provides opportunities for creating very colorful light sources that employ single color light emitters to create very narrow band and, therefore, highly saturated colors of light emission. This characteristic may be particularly desirable for visual displays, which typically employ a mosaic of three different colors of light-emitting elements to provide a full-color display.

Applications do exist, however, in which it is desirable to provide less saturated light emission and/or highly efficient light emission. One application for highly efficient, broadband light emission is general lighting devices. Within this application area, there are multiple requirements that such a light source must provide. First, the light source must provide at least one color of light that is perceived to be white. This white light requirement is typically specified in terms of color temperature or coordinates within either the 1931 Commission Internationale de l'Eclairage (CIE) chromaticity diagram or the 1976 CIE uniform chromaticity scale diagram. It is most desirable to create light sources that provide outputs having color coordinates that match typical blackbody radiators or typical daylight lighting conditions. The colors of light that exist during the day typically fall near a curve referred to as the Planckian Locus or black body curve within either the 1931 CIE chromaticity diagram or the 1976 CIE uniform chromaticity scale diagram. FIG. 1 shows the well-known CIE 1976 uniform chromaticity scale diagram illustrating the locus of monochromatic colors 10, and the Planckian Locus 12 for blackbody radiators having correlated color temperatures between 3000K and 10000K. Standardized lighting conditions that are desirable to attain, and that fall near this curve include D50, D65, and D93, where the numbers refer to the correlated color temperatures 5000K, 6500K and 9300K of the respective blackbody radiators. These points are shown in FIG. 1 as 14*a*, 14*b* and 14*c*, respectively. Secondly, the light source must be highly energy efficient. Within the industry, it is typical to employ light-emitting materials in a single package to form a single light source. For example, typical fluorescent light bulbs employ at least a red, green, and blue phosphor to form the desired color of light emission. Further, Organic Light Emitting Diode (OLED) light source prototypes have been demonstrated that employ multiple dopants in a single or in multiple layers to form a white light source. However, within these systems, the spectral characteristics of light emission are highly dependent upon the molecular structure of the material that forms the light-emissive layer or the dopant that is applied, and therefore device designers must select among relatively few materials, all of which have different radiant efficiencies and spectral emission characteristics. Finally, light sources capable of producing multiple colors of light are desired in many applications, including lamps for general purpose lighting that allow the user to easily and continuously adjust the color temperature of the light, and white light sources for displays wherein the white point of the display can be easily and continuously adjusted at the time of manufacture or during their use.

Light sources having color temperature regulation have been discussed by Okumura in US patent application 2004/0264193, entitled "Color Temperature-Regulable LED Light". Within this disclosure, at least two different embodiments of different emitters are employed. In a first embodiment, a white LED, which is typically formed from a substance emitting blue or ultraviolet light together with a phosphorescent substance that absorbs this high energy light and re-emits lower energy broadband light, is employed together with typical narrow-band blue and a yellow LEDs. Within this embodiment, the emission from the phosphorescent substance forms a broadband emission necessary to have a reasonable color spectrum with respect to daylight. The light from the blue and yellow LEDs is then mixed with the white emitter to shift the color temperature of the light to a desired color temperature. In a second embodiment, three LEDs are employed, again with at least one of these having a phosphor coating to produce broadband light, one having a blue emission, a second having a yellow emission and a third having an orange emission. Each of these embodiments employs a light with at least three emissive LEDs, which are addressed independently from one another. Therefore, the light from which must properly balanced and mixed to produce the intended light output. The first embodiment in the Okumura disclosure provides three LEDs, the color points of which all are discussed as lying near a single line through a CIE chromaticity space. This fact reduces the tendency of the color of the light to shift away from the Planckian Locus if one LED fades faster than another since they lie along a line that is nearly parallel to the Planckian Locus. Unfortunately, this embodiment requires that either the blue or yellow LED be employed with the white LED. Therefore, if the system is not calibrated properly or if one of the LEDs ages at a different rate than another, it is likely that a luminance shift will occur at the point where one LED is turned off and the other is turned on. This has the potential to create a discontinuous change in color temperature as well as a sudden perceptual change in the perceived brightness of the lamp.

Duggal in U.S. Pat. No. 6,841,949, entitled "Color tunable organic electroluminescent light source" also provides for a color tunable light. This light, however, once again employs three colored emitters to provide the necessary color range. However, this embodiment employs a triplet of OLEDs with a diffusing layer to produce the range of colored light. Once again, the presence of three (e.g., red, green and blue) elements within the lamp to allow the lamp to obtain a range of CIE chromaticity coordinates, requires complex control of the current provided to the three independently-addressable, light-emitting elements. The proportion of light from the three light-emitting elements must be controlled to create the exact color coordinates of daylight sources, while factors such as unequal aging of the three lamps makes formation of daylight colors difficult.

In the open technical literature, studies have been published that demonstrate the ability to stack multiple layers of quantum dots within a single addressable light-emitting element, the individual layers being tuned to complementary wavelength bands to achieve the emission of white light. For example, in the article "From visible to white light emission by GaN quantum dots on Si(111) substrate" by B. Damilano et al. al. (Applied Physics Letters, vol. 75, p. 962, 1999), the ability to effect continuous tuning of a single light-emitting element during synthesis, from blue to orange, by control of the quantum dot size is demonstrated. A sample containing four stacked planes of differently sized quantum dots within a single light-emitting element was shown to produce white light, as demonstrated via photoluminescence spectra. Electroluminescent white light emission was not demonstrated, nor was continuous color tuning with a fixed material set.

US 2006/0043361 discloses a white light-emitting organic-inorganic hybrid electroluminescence device. The device comprises a hole-injecting electrode, a hole-transport layer, a semiconductor nanocrystal layer, an electron transport layer and an electron-injecting electrode, wherein the semiconductor nanocrystal layer is composed of at least one kind of semiconductor nanocrystals, and at least one of the aforementioned layers emits light to achieve white light emission. The semiconductor nanocrystal layer of this device may also be composed of at least two kinds of nanocrystals having at least one difference in size, composition, structure or shape. Organic materials are employed for the transport layers, whereas inorganic materials are employed for the nanocrystals and the electrodes.

U.S. Pat. No. 7,122,842 discloses a light emitting device that produces white light, wherein a series of rare-earth doped group IV semiconductor nanocrystals are either combined in a single layer or are stacked in individual RGB layers to produce white light. In one example, at least one layer of Group II or Group VI nanocrystals receives light emitted by the Group IV rare-earth doped nanocrystals acting as a pump source, the Group II or Group VI nanocrystals then fluorescing at a variety of wavelengths. Neither US 2006/0043361A1 nor U.S. Pat. No. 7,122,842 B2 demonstrates color tuning during device operation.

US 2005/0194608A1 discloses a broad-spectrum $Al_{(1-x-y)}In_yGa_xN$ white light emitting device which includes at least one broad-spectrum blue-complementary light quantum dot emitting layer and at least one blue light emitting layer. The blue-complementary quantum dot layer includes plural quantum dots, the dimensions and indium content of which are manipulated to result in an uneven distribution so as to increase the spectral width of the emission of the layer. The blue light emitting layer is disposed between two conductive cladding layers. Various examples are described in which the blue-complementary emission is achieved by means of up to nine broad spectrum emitting layers, and the blue emission is achieved by up to four blue emitting layers. Such a device does allow the possibility of color temperature variation during synthesis and manufacturing, however, it is achieved through a laborious selection of materials and these materials remain fixed after manufacture.

Therefore, there is a need for a simpler, efficient white light source of continuously adjustable color temperature.

SUMMARY OF THE INVENTION

The aforementioned need is met, according to the present invention, by providing a white-light electroluminescent device having an adjustable color temperature that is substantially on a predetermined range of a Planckian locus within the 1976 Commission Internationale de l'Eclairage (CIE) uniform chromaticity scale diagram. According to one embodiment of the present invention, a first light-emitting element having a fixed ratio of at least two different species of emitters combined to produce a set of chromaticity coordinates at a predetermined white point substantially on the Planckian locus. A second light-emitting element having at least a single species of emitters produces a set of chromaticity coordinates. The set of chromaticity coordinates are positioned along a projected line extending from the Planckian locus and through the chromaticity coordinates of the first light-emitting element. A controller adjusts the voltage or current associated with the first and second light-emitting elements to provide white light with a predetermined range of chromaticity coordinates substantially on the Planckian locus.

Another aspect of the present invention provides a method of making a white light electroluminescent device that includes the steps of:

a. forming a first electrode layer over a substrate;

b. selecting at least two different species of emitters that combine to form a predetermined white point substantially on a Planckian locus within the 1976 CIE uniform chromaticity scale diagram;

c. forming a first light-emitting layer over at least a portion of the first electrode layer having a fixed ratio of the at least two different species of emitters to achieve the predetermined white point substantially on the Planckian locus;

d. optionally forming an intermediate electrode over the first light-emitting layer;

e. selecting a third species of emitter that produces a set of chromaticity coordinates positioned along a projected line extending from the Planckian locus and through the chromaticity coordinates of the first light-emitting layer;

f. forming a second light-emitting layer over at least a portion of the first electrode layer having the third species of emitters chromaticity coordinates positioned along a projected line extending from the Planckian locus and through the chromaticity coordinates of the first light-emitting layer;

g. forming a second electrode layer over the first and second light-emitting layers; and h. connecting a controller to the first and second light-emitting layers, for adjusting the voltage or current associated with the first and second light-emitting layers to provide white light with a predetermined range of chromaticity coordinates substantially on the Planckian locus.

DETAILED DESCRIPTION OF THE INVENTION

Figure 1:
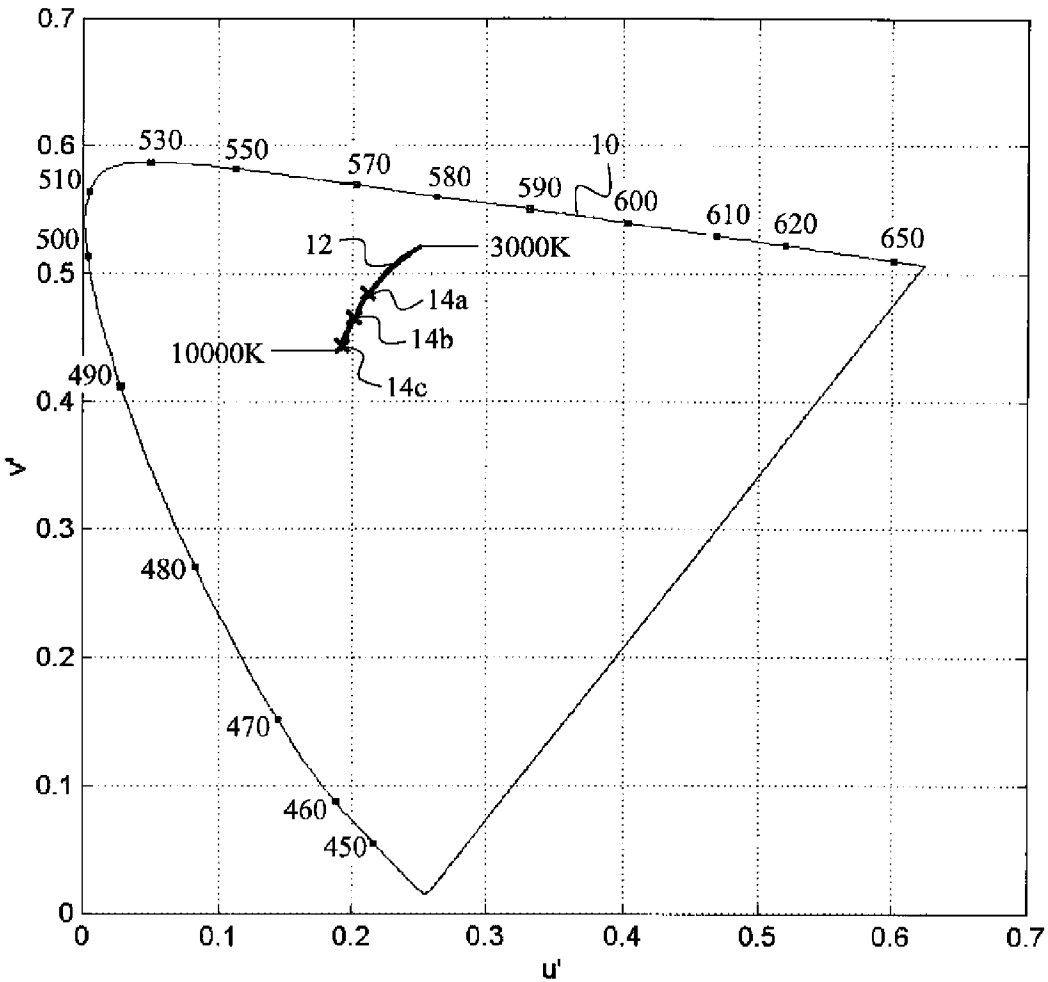
FIG. 1 (PRIOR ART)
FIG. 1 is a 1976 CIE uniform chromaticity scale diagram illustrating the u'v' chromaticity coordinates of the Planckian locus and three reference white points, known in the prior art.
Figure 2B:
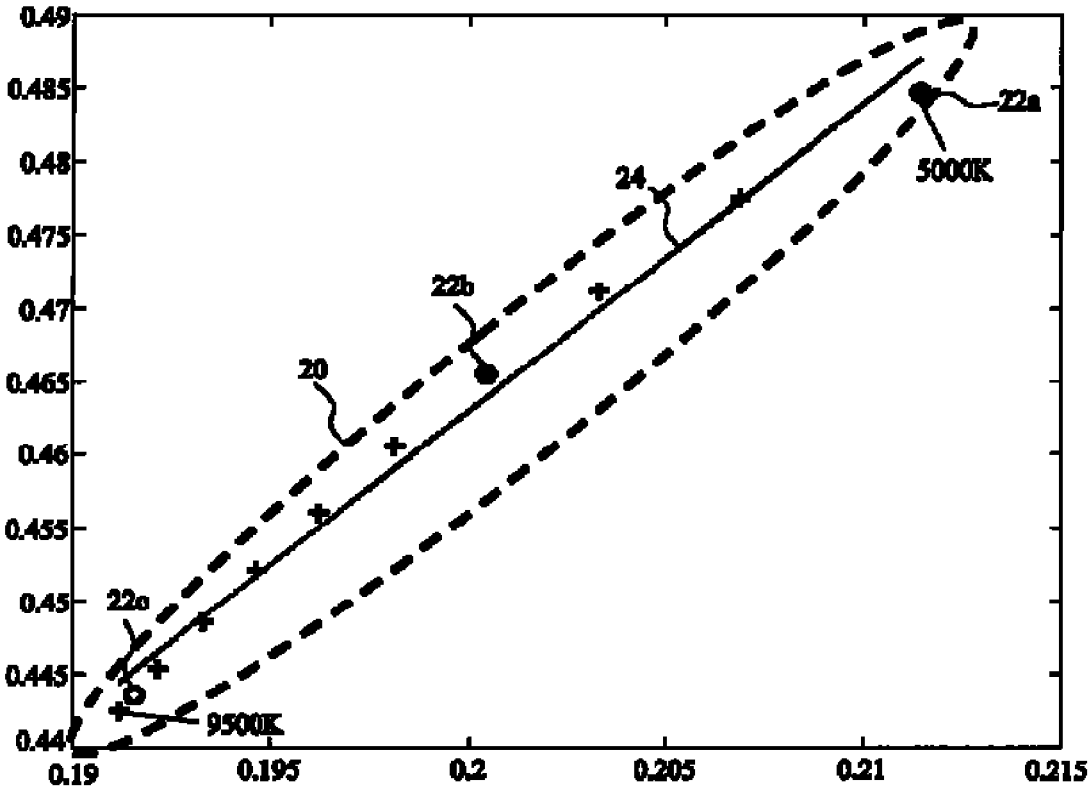
FIG. 2 is a 1976 CIE uniform chromaticity scale diagram with a companion plot illustrating a linear fit of the Planckian locus over a restricted range of color temperatures according to one embodiment of the present invention.
Figure 2A:
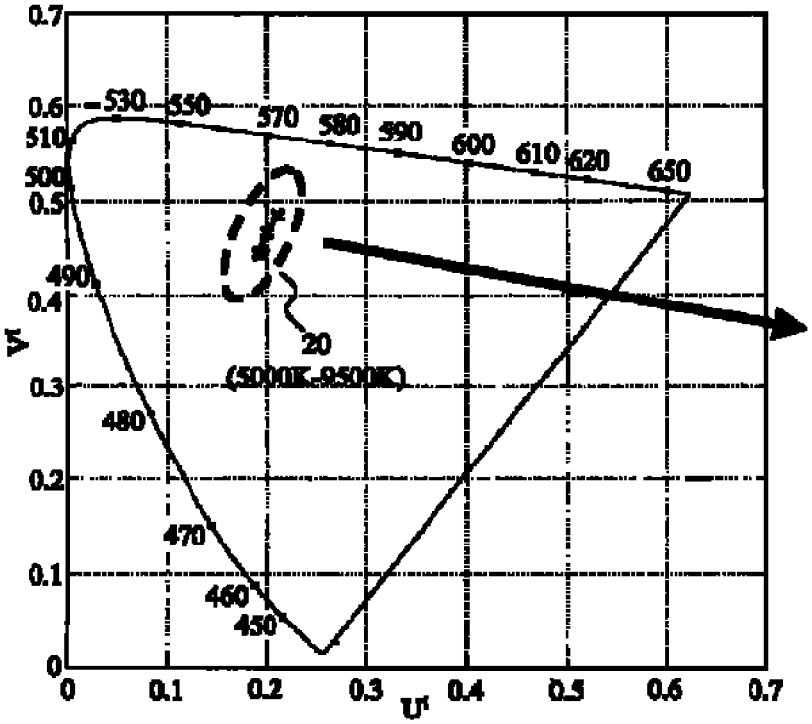
Figure 3:
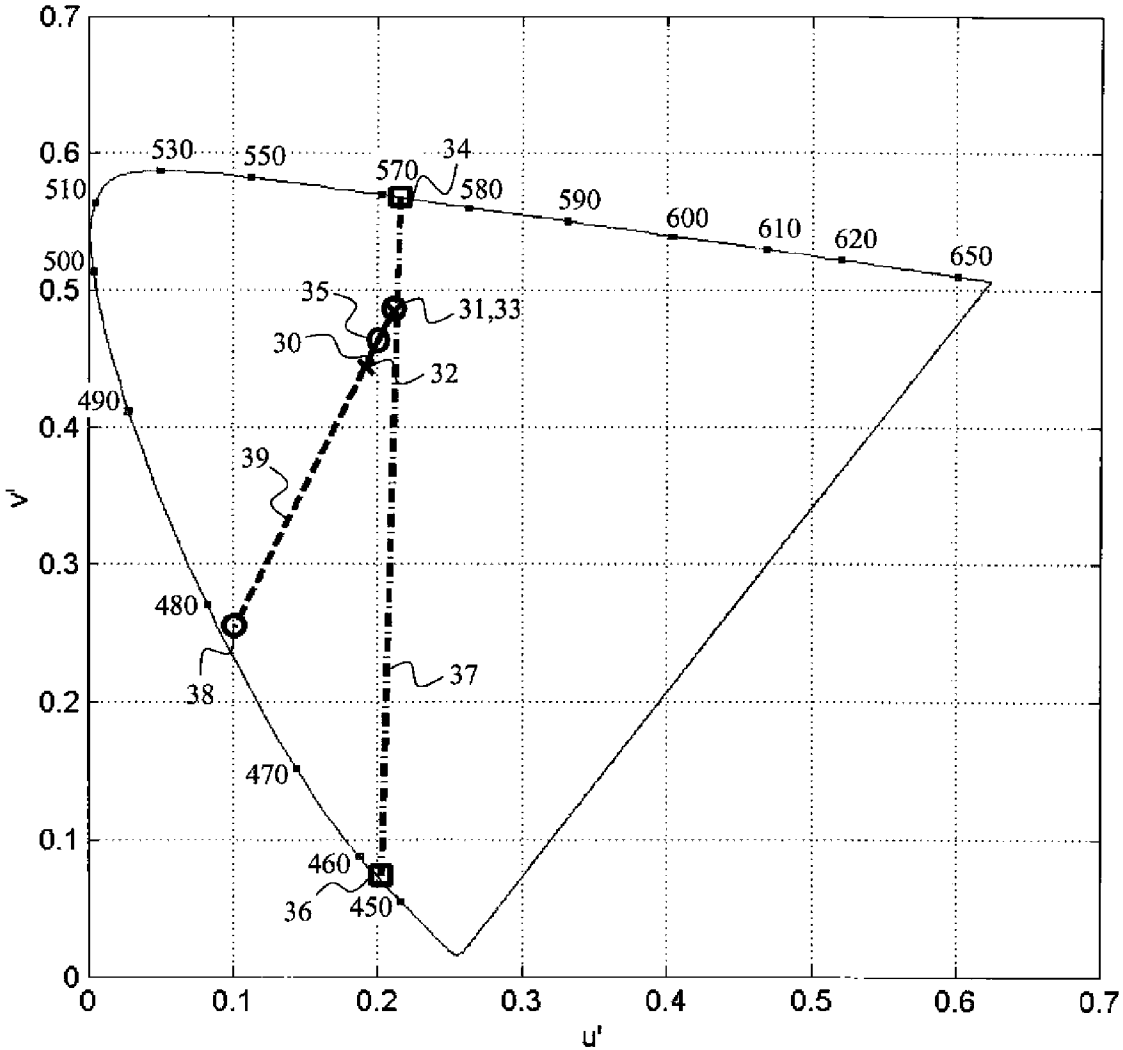
FIG. 3 is a 1976 CIE uniform chromaticity scale chromaticity diagram illustrating the placement of emitters and emitting species according to one embodiment of the present invention.

FIG. 2*a* shows a 1976 CIE uniform chromaticity scale diagram in which a group 20 of possible device white points is shown, all of which lie along the Planckian locus. In FIG. 2*a*, a range of blackbody radiator temperatures from 5000K to 9500K is shown (solid line) along with the three reference white points D50 22*a*, D65 22*b* and D93 22*c* mentioned earlier. This range of color temperatures is frequently used to set the white reference point of display or lighting devices. FIG. 2*a* shows the group 20 of possible device white points on the same scale as in FIG. 1. In accord with the present invention, FIG. 2*b* shows this family in more detail. It is observed that the group 20, whose individual data points are indicated in FIG. 2*b* by plus signs, are well fit by a straight line 24 over this region of the Planckian locus. To illustrate the present invention, FIG. 3 shows the linear fit 30 of the Planckian locus plotted on a 1976 CIE uniform chromaticity scale diagram, with the endpoints 31 and 32 representing the 5000K and 9500K blackbody radiators, respectively. Any of the white colors along the Planckian locus over this range can be approximated by forming a single ratio of luminous intensities for two light-emitting elements chromaticity coordinates on the fitted line 30. Such light-emitting elements may be realized in a variety of ways.

Figure 10:
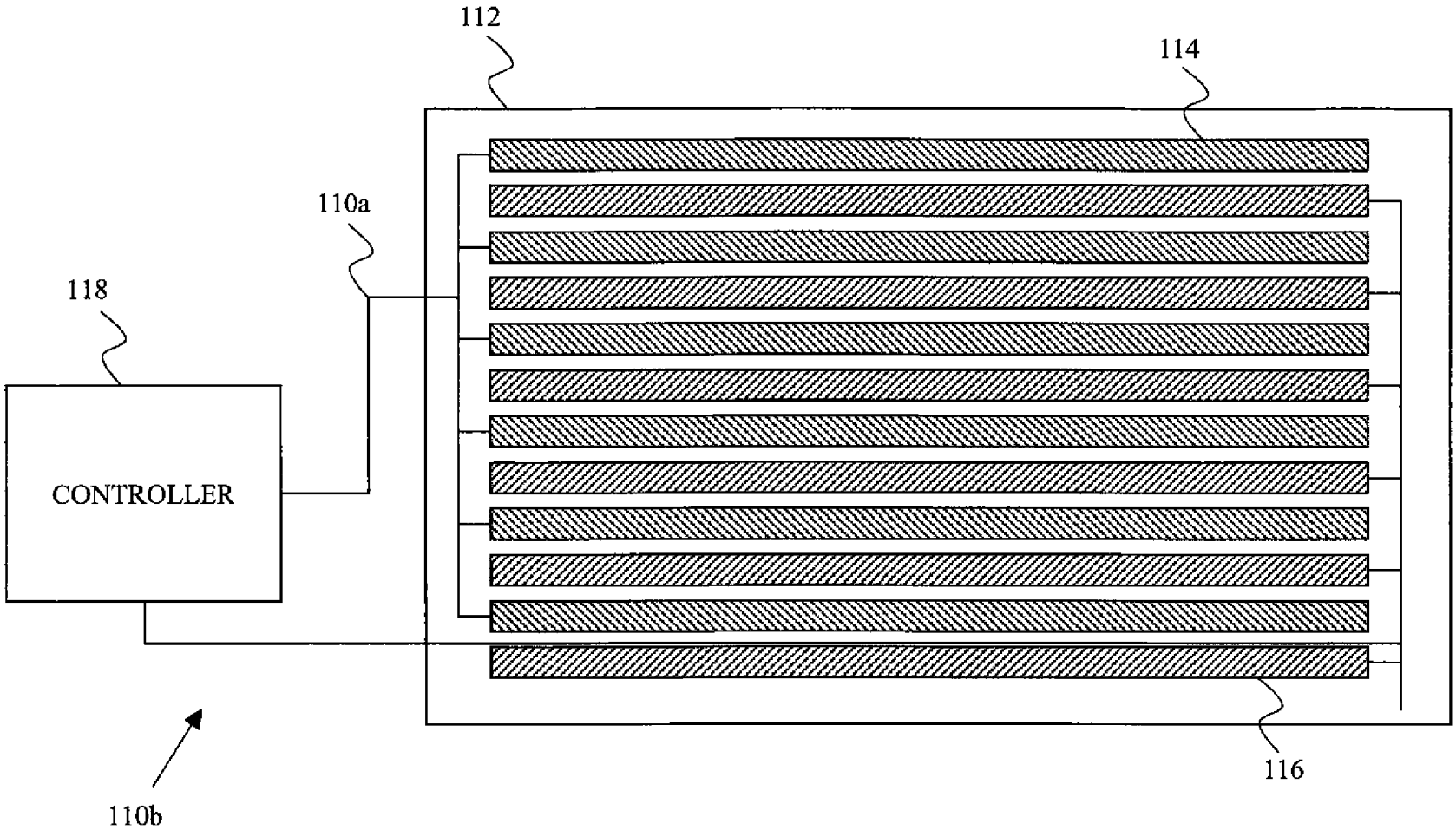
FIG. 10 is a schematic of an electro-luminescent light-emitting device according to one embodiment of the present invention.

In accord with the present invention, an electro-luminescent light-emitting device is formed as shown in FIG. 10. This electro-luminescent device includes a light source 112. The light source 112 includes a first light emitting element 114 formed such that its chromaticity coordinates 33 in the 1976 CIE uniform chromaticity scale diagram of FIG. 3 match the endpoint 31 of the linear fit of the Planckian Locus. A second light emitting element 116 is selected to have chromaticity coordinates 38 in the 1976 CIE uniform chromaticity diagram of FIG. 3 that lie on a line 39 that extends the fitted line 30 from the Planckian locus towards the spectrum locus. The electroluminescent device further includes a controller 118 and signal lines 110*a* and 110*b* for providing independent control signals to the light-emitting elements 112 and 114. This controller 118 adjusts the voltage or current associated with the first and second light-emitting elements 112, 114 to provide white light with a predetermined range of chromaticity coordinates substantially on the Planckian locus. By independently adjusting the voltage or current to each light-emitting element, the relative luminous output of the light emitting elements having chromaticity coordinates 33 and 38, the colors along the line 39 between the chromaticity coordinates of these light-emitting elements may be generated. In particular, any white color 35 along the fitted line 30 may be generated, and thus a white light-emitting device of adjustable color temperature at a predetermined white point on the Planckian locus is obtained.

In one exemplary embodiment, the first light-emitting element having chromaticity coordinates 33 has a fixed ratio of at least two different species of emitters that are combined to position the first light emitting element at a predetermined white point on the Planckian locus. Furthermore, the second light-emitting element having chromaticity coordinates 38 has at least a single, third species of emitter that produces a set of chromaticity coordinates 38 positioned along a projected line 39 extending from a line 30 which is fit to a portion of the Planckian locus and through the chromaticity coordinates 33 of the first light-emitting element. In this embodiment, the section of the line 39 that extends from the line 30 between the D50 and D93 color points, i.e. the 5000K and 9500K blackbody radiators, will pass within 0.05 units of the D50 and D93 color points within the 1976 CIE uniform chromaticity scale diagram. This ensures that white colors created using the fitted line 30 will be sufficiently close to the desired white points on the Planckian Locus. The two different species of emitters that combine to produce chromaticity coordinates 31 themselves lie along a line 37 in the chromaticity space. The endpoints of the line 37 correspond to the chromaticity coordinates of the two emitting species 34 and 36. These two emitting species 34, 36 are deposited in a single light-emitting element 114 and are preferably not addressable. However, the chromaticity coordinates of this single light-emitting element 114 are generally achieved by adjusting the concentration of these two emitting species within the light-emitting layer(s) of the light-emitting element 114 during manufacturing.

To produce the white color 35, one must control the relative luminous intensity of the two light emitting elements 114, 116. In an exemplary embodiment, the first and second light-emitting elements 114, 116 are connected to a controller 118. One embodiment of a controller useful in practicing this invention is shown in more detail in FIG. 4 as 41. The controller 41 will typically either provide a fixed ratio of light output or allow the ratio to be dynamically adjusted. When a fixed ratio is to be provided, a single electroluminescent device may be manufactured and its color temperature controlled by attaching very similar control mechanisms to the electroluminescent device, allowing the production of multiple white light electroluminescent devices from a single manufacturing process. This can reduce the cost of manufacturing devices having different colors of light output. Dynamic adjustment of the EL device's color temperature by the user requires a mechanism for dynamic color control of the device, and provides additional customer value.

Figure 4:
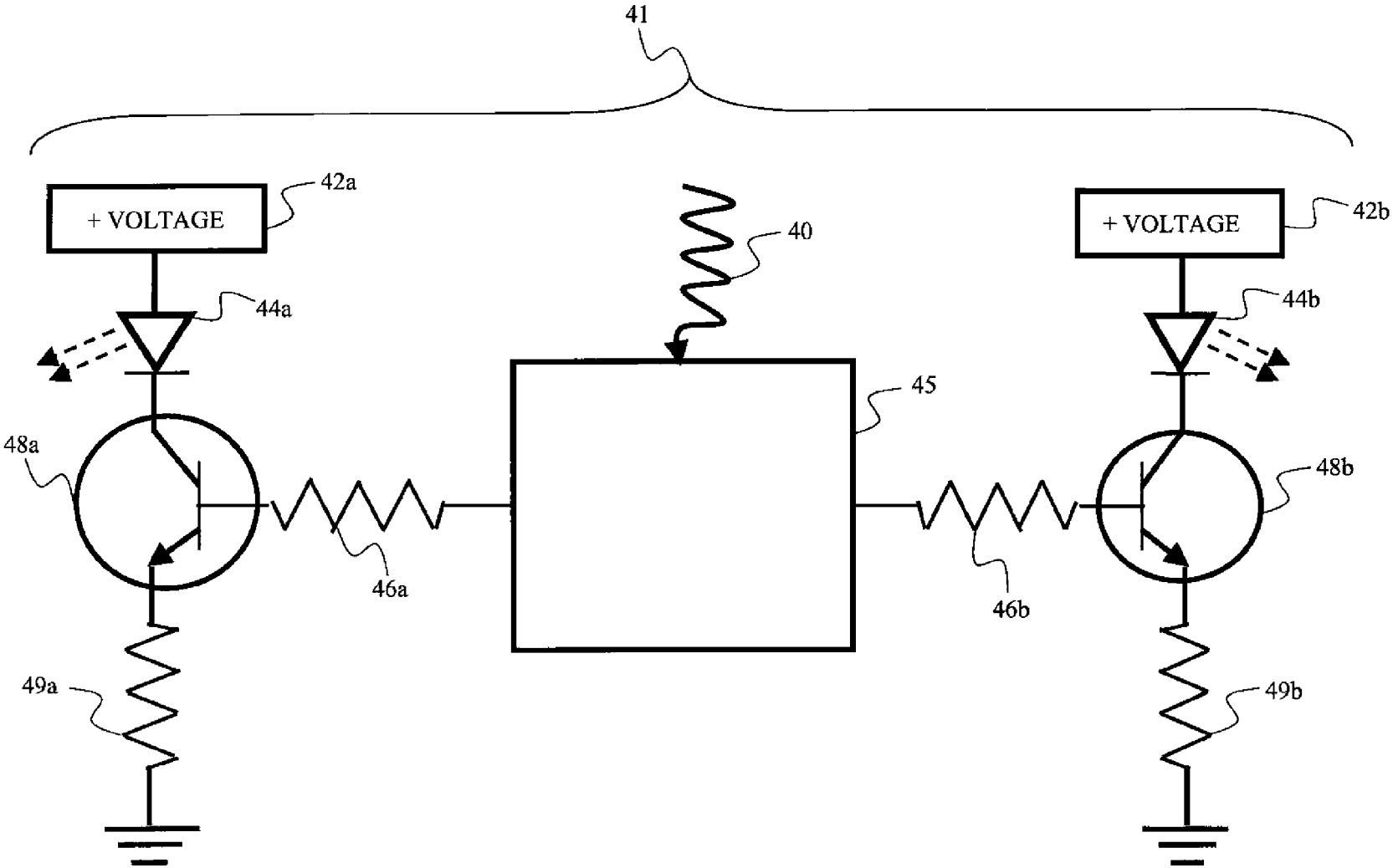
FIG. 4 is a schematic of a controller useful in practicing the present invention.

FIG. 4 shows a schematic of controller 41 useful in practicing the present invention. In general, the light output of an electroluminescent light-emitting element is proportional to its drive current, and therefore the controller 41 may be any controller that controls the relative current to the two light-emitting elements, either by directly modulating the current or by modulating the voltage to indirectly modulate the average current. One such drive circuit design for converting a source voltage to a current is shown in FIG. 4. In FIG. 4, power supplies 42*a* and 42*b* are connected to light-emitting elements 44*a* and 44*b*, here shown as light-emitting diodes (LEDs). In response to a control signal 40, a digital to analog converter 45 applies a voltage signal across resistors 46*a* and 46*b* to the gates of transistors 48*a* and 48*b*, respectively. The resistors 46*a* and 46*b* are small, and are included to prevent instabilities in the voltages applied to the transistor gates. The signals applied to the transistors 48*a* and 48*b* control the amount of current flowing through them, and in turn, the amount of current that can flow through the LEDs 44*a* and 44*b*. The resistors 49*a* and 49*b* serve to further regulate the LED currents. Control of the LED currents provides direct control of the LED light outputs. The control signals sent by the digital to analog converter 45 to the transistors 48*a* and 48*b* will depend on the desired output ratio, and will be prescribed by the input digital signal 40. Although this embodiment employs a digital controller 41, equivalent analog controllers can also be applied.

Figure 5:
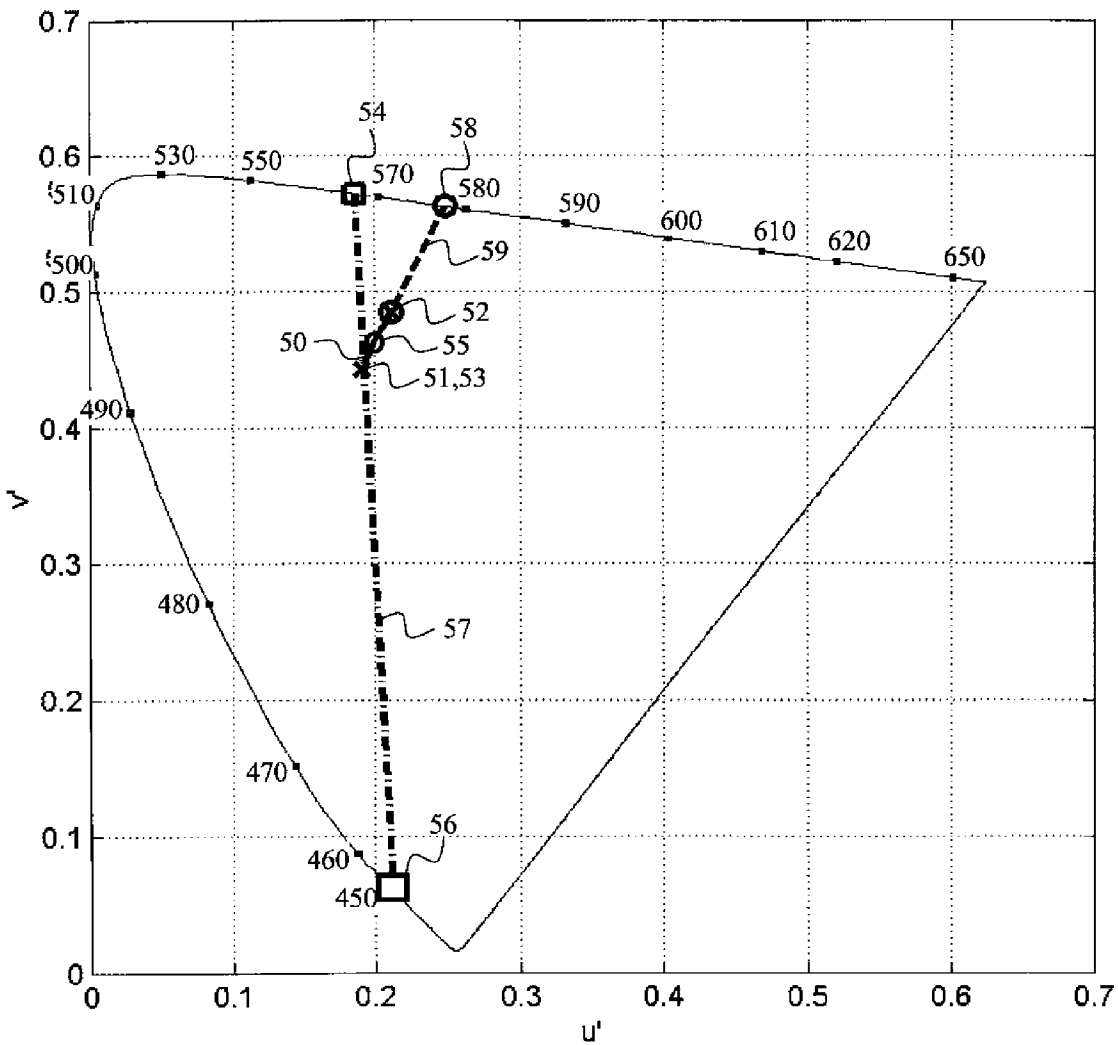
FIG. 5 is a 1976 CIE uniform chromaticity scale chromaticity diagram illustrating the placement of emitters and emitting species according to one embodiment of the present invention.

In another embodiment, as depicted in the 1976 CIE uniform scale diagram of FIG. 5, the first light emitting element 114 has chromaticity coordinates 53 that coincide with the 9500K blackbody radiator point 51, and the line 50 is fitted to the Planckian Locus between 51 and the 5000K point 52. The second light-emitting element 116 is now formed such that its chromaticity coordinates 58 are placed at the end of a line 59, which extends the line 50 from the Planckian locus to the chromaticity coordinates 58 of the second emitter. Two different species of emitters combine in a fixed ratio to produce the chromaticity coordinates 53 of the first light-emitting element 114, wherein the chromaticity coordinates 53 lie along a line 57 in the chromaticity space, the endpoints of which correspond to the chromaticity coordinates 54 and 56 of the two emitting species which produce the light of the first light-emitting element 114. By adjusting the relative output of the light emitting elements first 114 and second 116 light-emitting elements having chromaticity coordinates 52 and 58, any white color 55 along the fitted line 50 may be generated, and thus a white light-emitting device of adjustable color temperature at a predetermined white point substantially on the Planckian locus is obtained.

Returning to FIG. 3, in one embodiment, the first light-emitting element 114 having chromaticity coordinates 33 contains two different species of emitters providing complementary colors of yellow and blue light, corresponding to chromaticity coordinates 34 and 36, respectively. Furthermore, when formed in the proper proportion the species of emitters in the first light-emitting element 114, which have the chromaticity coordinates of the complementary colors 34 and 36 define one of the endpoints of the line 37 such that it intersects the Planckian locus within the interval $0.175 <= u' <= 0.225$. As demonstrated in a copending US patent application by Miller et al., serial number to be assigned, entitled, "Lamp with Adjustable Color", such combinations of two different species provide white light with the highest luminous efficacy, i.e. the highest ratio of lumens per Watt. Maximizing this quantity is a key factor in minimizing the power consumed by a white light-emitting device.

In one embodiment, the light emitted by the second light-emitting element 116 has a dominant wavelength between 475 nm and 480 nm. Table I shows the integrated radiant power under a white light spectral power distribution, for a luminance of 100 cd/m$^2$ as a function of the color temperature, wherein the resulting colors of white light are produced by the proper combinations of light output from a first light-emitting element 114 comprised of complementary yellow and blue species of emitters having dominant wavelengths of 572 nm and 452 nm, respectively, and a second light-emitting element 116 comprised of a third species of emitter having a dominant wavelength with a value of 478 nm. As shown in this table, the integrated radiant power is minimum for the color temperature closest to the region in the 1976 CIE uniform chromaticity scale diagram of maximum visual sensitivity on the spectrum locus, that is the D5000 white point in this example.

TABLE I

Integrated radiant power as a function of color temperature according to one embodiment of the present invention.

| | Color Temperature (degrees K) | | | | | | | | | |
|---|---|---|---|---|---|---|---|---|---|---|
| | 5000 | 5500 | 6000 | 6500 | 7000 | 7500 | 8000 | 8500 | 9000 | 9500 |
| Integrated Radiant Power at 100 cd/m$^2$ | 169.8 | 182.1 | 192.0 | 200.3 | 207.1 | 212.8 | 217.7 | 221.7 | 225.4 | 228.5 |

In an embodiment requiring overall lower integrated radiant power, the light emitted by the second light-emitting element 116 has a dominant wavelength between 575 nm and 580 nm. As Table II shows, when this dominant wavelength has a value of 578 nm, the integrated radiant power under a white light spectral power distribution produced by a combination of this light-emitting element 116 and a first light-emitting element 114 comprised of complementary yellow and blue species of dominant wavelengths of 566 nm and 448 nm, respectively, varies as a function of the color temperature, and once again is minimum for the color temperature closest to the region of maximum visual sensitivity. In this case, the same integrated radiant power is used to form the D50 white point, however every other white point is more efficient than the previous embodiment, and improves up to about 10% at a 9500K white point. This is because the second light-emitting element emits light that is in the orange region of the spectrum, rather than the blue, and is therefore in a region of chromaticity space that is higher in luminous efficacy (lumens per Watt).

TABLE II

Integrated radiant power as a function of color temperature according to the preferred embodiment of the present invention.

| | Color Temperature (degrees K) | | | | | | | | | |
|---|---|---|---|---|---|---|---|---|---|---|
| | 5000 | 5500 | 6000 | 6500 | 7000 | 7500 | 8000 | 8500 | 9000 | 9500 |
| Integrated Radiant Power at 100 cd/m$^2$ | 170.2 | 177.2 | 182.9 | 187.6 | 191.5 | 194.7 | 197.5 | 199.8 | 201.9 | 203.6 |

As shown, the embodiment of FIG. 3 is preferred when the primary goal is to minimize power consumption. However, other embodiments may be preferred when other criteria are applied. For example, in general purpose lighting, it is often important to achieve at least a minimum color rendering index value. Under these conditions, it will be important to provide additional species of emitters having dominant wavelengths that are separated by distances that are on the order of the full-width half maximum of the spectral output of each of the species. Further, it may be important that the spectral power distribution that results from combining the output of the two light-emitting elements approximates the spectral power distribution of each of the light-emitting elements. Such embodiments of the present invention are discussed in co-filed, co-pending US patent application, by Miller et al., entitled, "Lamp with Adjustable Color," serial number to be assigned, by Miller et al., which is herein included by reference.

Figure 6:
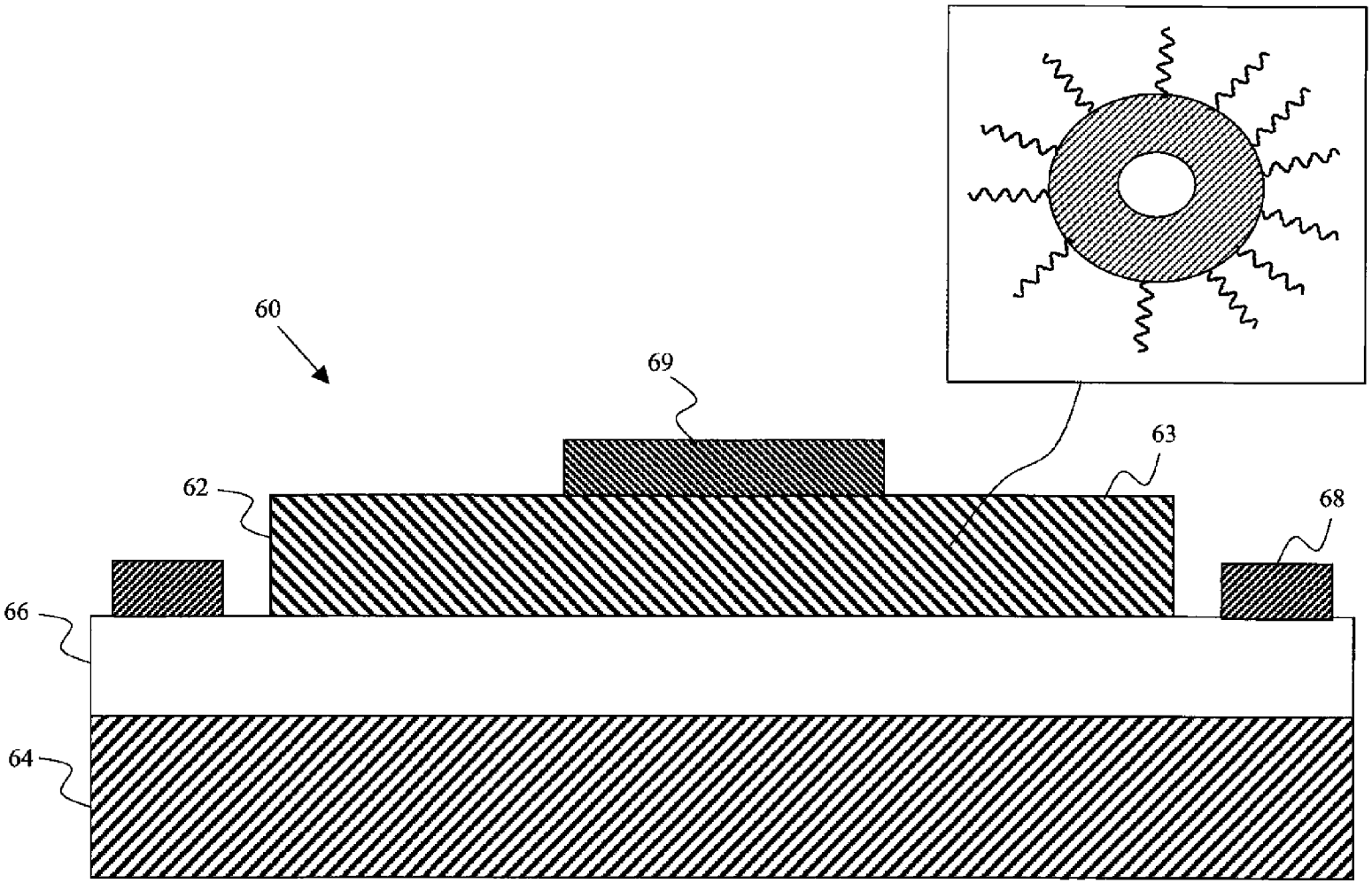
FIG. 6 is a cross-sectional view of an inorganic light-emitting diode useful in forming a light-emitting element of the present invention.

FIG. 6 shows a cross sectional view of an inorganic light-emitting diode 60 useful in forming a light-emitting element of the present invention. As shown in this figure, the light-emitting diode 60 incorporates the quantum dot inorganic light-emitting layer 62. A substrate 64 supports the deposited semiconductor and metal layers Substrate 64 should preferably be sufficiently rigid to enable the deposition processes and that it can withstand the thermal annealing processes (maximum temperatures of ~285° C.). Substrate 64 can be transparent or opaque. Possible substrate materials are glass, silicon, metal foils, and some plastics. The next deposited material is an anode 66. For the case where the substrate 64 is p-type Si, the anode 66 is deposited on the bottom surface of the substrate 64. A suitable anode metal for p-Si is Al. It can be deposited by thermal evaporation or sputtering. Following its deposition, it will preferably be annealed at ~430° C. for 20 minutes. For all of the other substrate types named above, the anode 66 is deposited on the top surface of the substrate 64 and is comprised of a transparent conductor, such as, indium tin oxide (ITO). Sputtering or other well-known procedures in the art can deposit the ITO. The ITO is typically annealed at ~300° C. for one hour to improve its transparency. Because the sheet resistance of transparent conductors, such as, ITO, are much greater than that of metals, bus metal 68 can be selectively deposited through a shadow mask using thermal evaporation or sputtering to lower the voltage drop from the contact pads to the actual device. Inorganic light emitting layer 62 is deposited next. It can be dropped or spin cast onto the transparent conductor (or Si substrate). Other deposition techniques, such as, inkjetting the colloidal quantum dot-inorganic nanoparticle mixture is also possible. Following the deposition, the inorganic light-emitting layer 62 is annealed at a preferred temperature of 270° C. for 50 minutes. Lastly, a cathode 69 metal is deposited over the inorganic light-emitting layer 62. Candidate cathode 69 metals are ones that form an ohmic contact with the material comprising the inorganic nanoparticles 62. For example, in a case where the quantum dots are formed from ZnS inorganic nanoparticles, a preferred metal is Al. It can be deposited by thermal evaporation or sputtering, followed by a thermal anneal at 285° C. for 10 minutes. Those skilled in the art can also infer that the layer composition can be inverted, such that, the cathode 69 is deposited on the substrate 64 and the anode 66 is formed on the inorganic light emitting layer 62. In this configuration, when the substrate 64 is formed from Si, the substrate 64 is n-type Si.

Although not shown in FIG. 6, a p-type transport layer and an n-type transport layer may be added to the device to surround the inorganic light-emitting layer 62. As is well-known in the art, LED structures typically contain doped n- and p-type transport layers. They serve a few different purposes. Forming ohmic contacts to semiconductors is simpler if the semiconductors are doped. Since the emitter layer is typically intrinsic or lightly doped, it is much simpler to make ohmic contacts to the doped transport layers. As a result of surface plasmon effects, having metal layers adjacent to emitter layers results in a loss of emitter efficiency. Consequently, it is advantageous to space the emitter layers from the metal contacts by sufficiently thick (at least 150 nm) transport layers. Finally, not only do the transport layers inject electron and holes into the emitter layer, but, by proper choice of materials, they can prevent the leakage of the carriers back out of the emitter layer. For example, if the inorganic quantum dots in the light-emitting layer 62 were composed of $ZnS_{0.5}Se_{0.5}$ and the transport layers were composed of ZnS, then the electrons and holes would be confined to the emitter layer by the ZnS potential barrier. Suitable materials for the p-type transport layer include II-VI and III-V semiconductors. Typical II-VI semiconductors are ZnSe, ZnS, or ZnTe. Only ZnTe is naturally p-type, while ZnSe and ZnS are n-type. To get sufficiently high p-type conductivity, additional p-type dopants should be added to all three materials. For the case of II-VI p-type transport layers, possible candidate dopants are lithium and nitrogen. For example, it has been shown in the literature that $Li_3N$ can be diffused into ZnSe at ~350° C. to create p-type ZnSe, with resistivities as low as 0.4 ohm-cm.

Suitable materials for the n-type transport layer include II-VI and III-V semiconductors. Typical 1'-VI semiconductors are ZnSe or ZnS. As for the p-type transport layers, to get sufficiently high n-type conductivity, additional n-type dopants should be added to the semiconductors. For the case of II-VI n-type transport layers, possible candidate dopants are the Type III dopants of Al, In, or Ga. As is well known in the art, these dopants can be added to the layer either by ion implantation (followed by an anneal) or by a diffusion process. A more preferred route is to add the dopant in-situ during the chemical synthesis of the nanoparticle. Taking the example of ZnSe particles formed in a hexadecylamine (HDA)/TOPO coordinating solvent, the Zn source is diethylzinc in hexane and the Se source is Se powder dissolved in TOP (forms TOPSe). If the ZnSe were to be doped with Al, then a corresponding percentage (a few percent relative to the diethylzinc concentration) of trimethylaluminum in hexane would be added to the syringe containing TOP, TOPSe, and diethylzinc. In-situ doping processes like these have been successfully demonstrated when growing thin films by a chemical bath deposition. It should be noted the diode could also operate with only a p-type transport layer or an n-type transport layer added to the structure. Those skilled in the art can also infer that the layer composition can be inverted, such that, the cathode 69 is deposited on the substrate 64 and the anode 66 is formed on the p-type transport layer. For the case of Si supports, the substrate 64 is n-type Si.

The inorganic light-emitting layer 62 will preferably be comprised of a plurality of light emitting cores, each core having a semiconductor material that emits light in response to a recombination of holes and electrons, each such light emitting core defining a first bandgap; a plurality of semiconductor shells formed respectively about the light emitting cores to form core/shell quantum dots, each such semiconductor shell having a second bandgap wider than the first bandgap; and a semiconductor matrix connected to the semiconductor shells to provide a conductive path through the semiconductor matrix and to each such semiconductor shell and its corresponding light-emitting core so as to permit the recombination of holes and electrons.

At least one of the two electrodes (i.e., anode 66 or cathode 69) will typically be formed of a transparent or semi-transparent material such as ITO or IZO. The opposing electrode will often be formed of a highly reflective material such as aluminum or silver, but may also be transparent. In a typical embodiment, the anode will be transparent and the cathode will be reflective, but the opposing structure is also viable. The hole and electron transport materials may be formed from inorganic semi-conducting materials as described above, and alternatively may also be formed from organic semi-conducting materials. Additional layers may also be placed into the structure to promote other functions, such as electron and hole injection from the electrodes; or electron or hole blocking layers to prevent electrons or holes from traveling past the light-emitting layer to recombine with oppositely charged particles near one of the electrodes. An inorganic light-emitting diode as just described with reference to FIG. 6 can provide one light-emitting element of a white-light electroluminescent device having an adjustable color temperature according to the present invention, and a second such diode can provide a second light-emitting element. In this exemplary embodiment, the first light-emitting element 114 may contain a first light-emitting layer having a fixed ratio of at least two different species of emitters that are combined to produce a set of chromaticity coordinates at a predetermined white point substantially on the Planckian locus, and the second light-emitting element 116 may contain a second light-emitting layer having at least a single species of emitters that produce a set of chromaticity coordinates, wherein the set of coordinates are positioned along a projected line extending from the Planckian locus and through the first light-emitting layer. It is preferable that the two light-emitting elements be formed in close proximity such that the light from them mixes and is perceived by the viewer to be white light, preferably by positioning the different colored white light-emitting elements next to each other.

Figure 7:
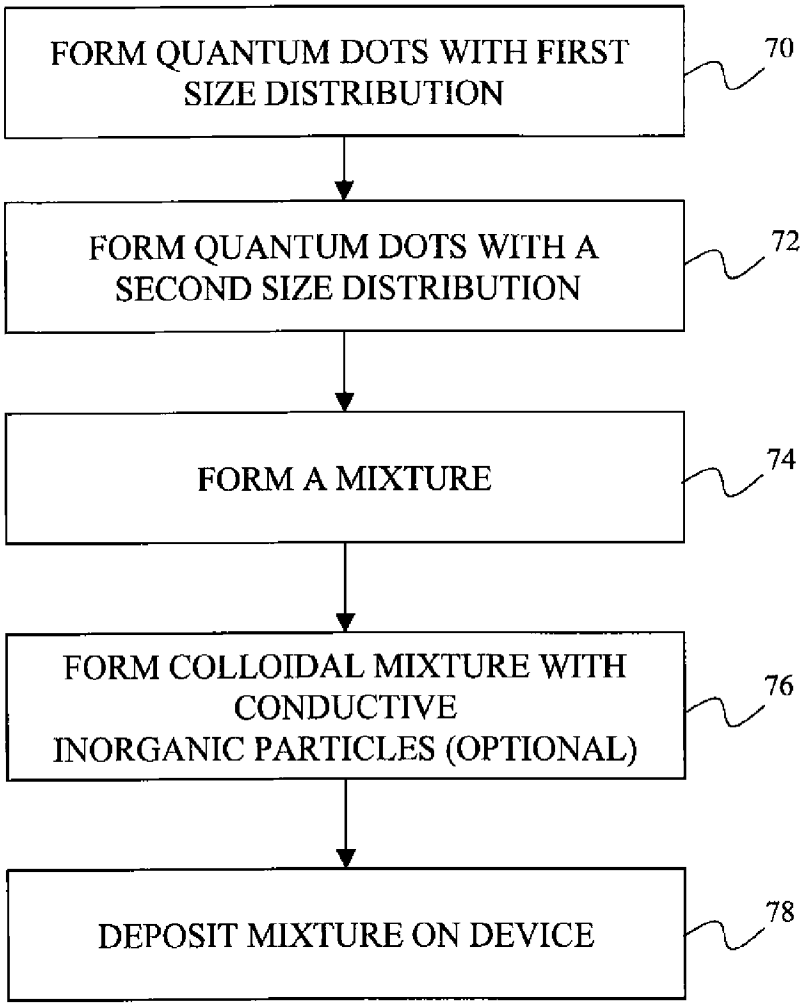
FIG. 7 is a process for fabricating a white light-emitting element according to one embodiment of the present invention.

It is important that within this invention, a light-emitting element is defined as any independently addressable group of electroluminescent diodes that emits light. That is, the controller 118 provides a separate signal (e.g., a separate voltage or current) to each of the two light-emitting elements 114, 116. This is illustrated in FIG. 10 by the two signal control lines 110*a* and 110*b*, each of which provides a separate signal from the controller 118 to each of the first 114 and second 116 light-emitting elements. Light-emitting elements can contain a mixture of species of emitters within a single light-emitting layer. Alternatively, light-emitting elements can contain multiple light-emitting layers, each containing one or more species of emitters. Further, light-emitting elements can be comprised of separate light-emitting layers formed from different species of emitters that are formed between separate pairs of electrodes when these electrodes are commonly addressed. The creation of a first light-emitting element having a fixed ratio of at least two different species of emitters that are combined to position the chromaticity coordinates of the first light emitting element at a predetermined white point substantially on the Planckian locus can involve synthesizing quantum dots of a first and second size within separate steps, and then depositing these quantum dots in the correct proportion onto the device. One process for fabricating such a device is depicted in FIG. 7. In this process, a first size distribution of quantum dots will be formed in operation 70. One such process has been discussed in co-pending U.S. application Ser. No. 11/226,622, filed Sep. 14, 2005 by Kahen, which is hereby included by reference. A second size distribution of quantum dots will also be formed 74 using a similar process, but will result in different sizes by varying the parameters of the reaction (e.g., time, temperature, or concentrations) that are used to form the quantum dots. A mixture of the two distributions will then be formed 76 by combining the resulting quantum dots into a common material to form a mixture containing quantum dots from each of the two size distributions. This mixture will contain a proportion of the number of quantum dots from the first size distribution to the number of dots from the second size distribution such that this proportion results in the predetermined white point. An optional operation 76 of forming a mixture of the two distributions or sizes of quantum dots with additional conductive inorganic particles may be performed. These additional conductive inorganic particles can, in some embodiments, be useful in forming a semi-conductor matrix, promoting the flow of holes and electrons to the quantum dots. Once this mixture of quantum dots is formed, the quantum dot mixture is deposited in process step 78 onto the device using conventional means.

Figure 8:
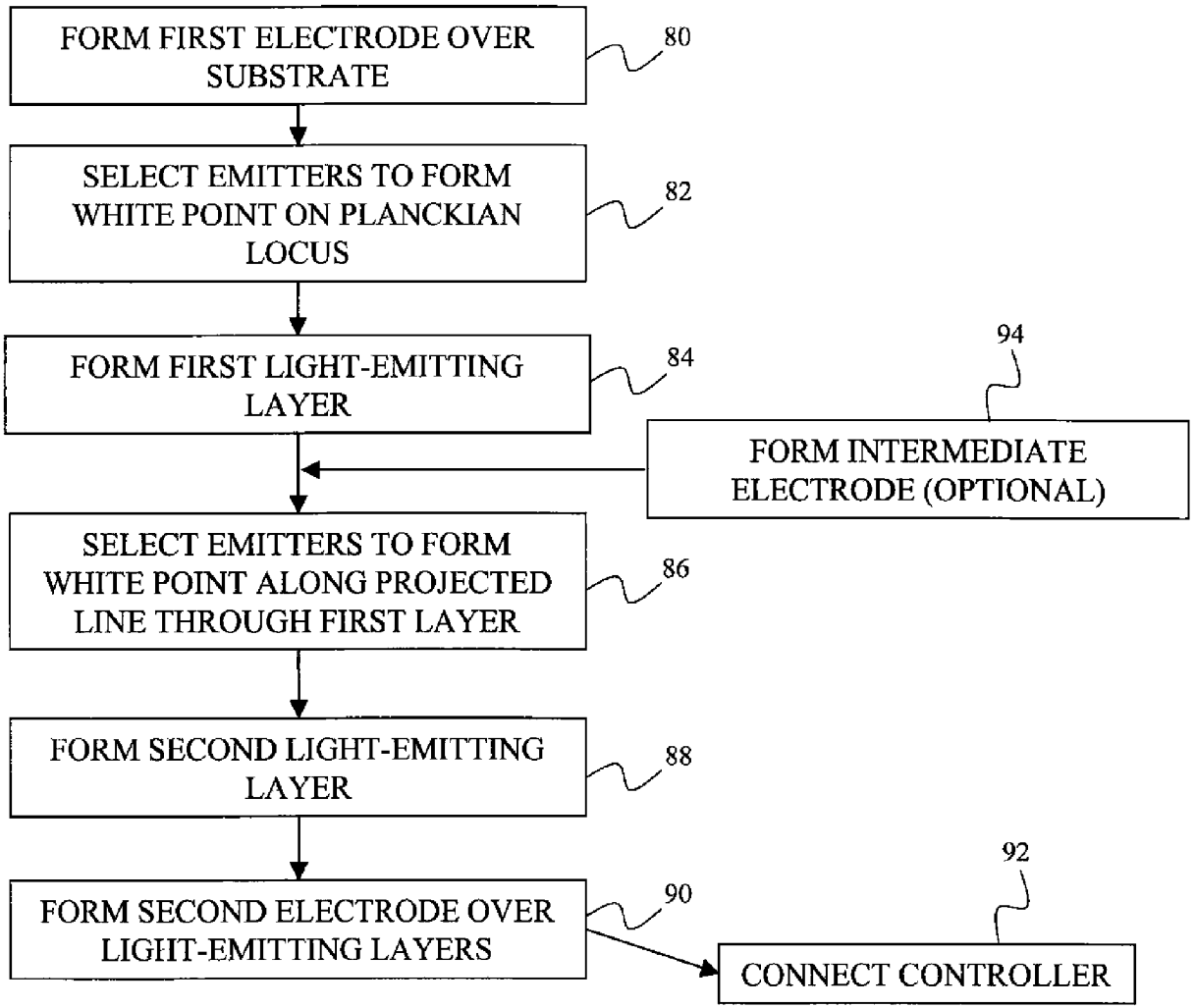
FIG. 8 is a method of making a white light electroluminescent light source according to one embodiment of the present invention.

In accord with the present invention and with reference to FIG. 8, a method of making a white light electroluminescent device comprises the steps of: forming 80 a first electrode layer over a substrate; selecting 82 at least two different species of emitters that combine to form a predetermined white point substantially on the Planckian locus; forming 84 a first light-emitting layer having a fixed ratio of the at least two different species of emitters to achieve the predetermined white point substantially on the Planckian locus over at least a portion of the first electrode layer; selecting 86 a third, at least single, species of emitter that produce a set of chromaticity coordinates positioned along a projected line extending from the Planckian locus and through the chromaticity coordinates of the first light-emitting layer; forming 88 a second light-emitting layer having the third, at least single species of emitters of chromaticity coordinates positioned along a projected line extending from the Planckian locus and through the first light-emitting layer over at least a portion of the first electrode layer; forming 90 a second electrode layer over the light-emitting layers; and connecting 92 a controller to the electrodes, for adjusting the voltage or current associated with the first and second light-emitting layers to provide white light with a predetermined range of chromaticity coordinates substantially on the Planckian locus. Again, it is preferable that the two light-emitting layers be formed in close proximity such that the light from them mixes and is perceived by the viewer to be white light; This can be accomplished by positioning differently colored white light-emitting elements next to each other as explained earlier. In this embodiment, at least one of the first and second electrode layers can be patterned along at least one dimension and connected such that a portion of the patterned electrode layers may receive a voltage or current that is independent of the voltage or current provided to the remainder of the patterned electrode layers. For example, in active matrix devices, typically only one of the electrodes will be patterned, but it will be patterned in two dimensions. In passive matrix devices or devices employing direct drive, the two electrodes will typically each be patterned along a single dimension, forming an orthogonal grid within passive matrix devices. In any case, alignment of the electrodes to the electroluminescent materials will be accomplished such that the electrodes are vertically stacked with respect to the electroluminescent material, such that the area of any electrode in an electrode layer lies within the corresponding perimeter of any corresponding luminescent area in an electroluminescent material layer. Further, in direct drive methods, both the top and bottom electrode layers may be identically patterned to provide independent control of only two elements.

In another embodiment, the two light-emitting layers can be vertically stacked. In this case, an intermediate electrode 94 is formed between the first and second light emitting layers, as indicated in FIG. 8. The controller is also connected to this intermediate electrode 94 and provides independent control of the output of first and second light-emitting layers.

Devices of the present invention may be employed in general purpose lighting or in displays. Although devices of the present invention may be employed in numerous display configurations, one particularly interesting display configuration provides a flat panel display capable of presenting high resolution monochrome images in a desired first white color and highlight images in at least a desired second color different from the first color while allowing the color of the white to be adjusted. Such a display would be comprised of a plurality of pixels, each pixel including two individually addressable differently colored light emitting sub-pixel elements. In this flat panel display the two individually addressable differently colored light emitting sub-pixel elements include a first light-emitting element having a fixed ratio of at least two different species of emitters that are combined to position the first light emitting element at a predetermined white point substantially on the Planckian locus and the a second light-emitting element will have at least a single species of emitters that produce a set of chromaticity coordinates, wherein the set of coordinates are positioned along a projected line extending from the Planckian locus and through the first light-emitting element. Besides providing the ability to adjust the color of the white light, the second light-emitting element provides the ability for a pixel to present an alternate color for highlighting within the high resolution monochrome display. Since these differently colored light-emitting sub-pixel elements will be ideally be arranged on a rectilinear grid such that the pair of differently colored light-emitting sub-pixel elements form a square pixel, a monochrome image may be displayed on a regular two-dimensional grid. As a result, sub-pixel elements will not have any visually apparent interruptions or apparent gaps that can cause visual distraction or mask important features within the image content.

Figure 9:
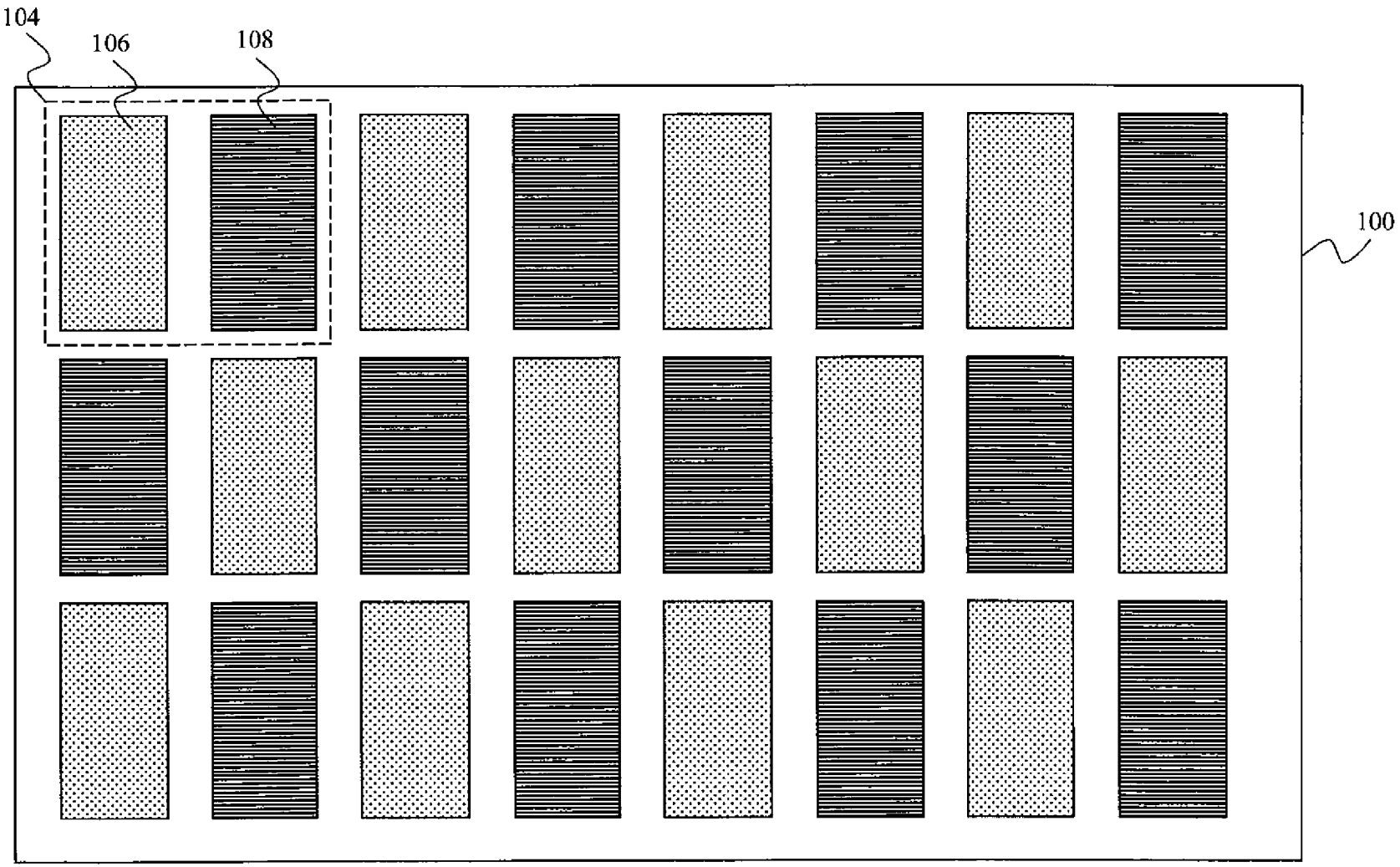
FIG. 9 is a flat panel display presenting monochrome images in a first white color and highlight images in at least a second color different from the first color, while allowing the color of the white to be adjusted, according to one embodiment of the present invention.

FIG. 9 shows such a display. As shown in FIG. 9, the display 100 is formed from an array of pixels. Each pixel 104 is formed from two individually addressable differently colored light emitting sub-pixel elements 106 and 108. When operated together in at the appropriate luminance ratio, these two individually addressable differently colored light emitting sub-pixel elements 106, 108 produce a high-resolution monochrome image, which is white in color and wherein the color temperature of the white can be adjusted. However, when only the second individually addressable differently colored light emitting sub-pixel elements are operated at any other luminance ratio, the pixel produces a second color of light, typically cyan or orange as discussed earlier, allowing highlight images to be shown.

By employing the pair of individually addressable differently colored light emitting sub-pixel elements to form a white pixel 14 with color adjustment within the display 10, a monochrome image may be displayed with color highlighting wherein the resulting display has only two subpixels per pixel. As such, the physical pixel resolution of the display device may be improved significantly as compared to a full-color flat panel display having three or more individually addressable differently colored light emitting sub-pixel elements per pixel. However, when only one individually addressable differently colored light emitting sub-pixel elements is turned on, the display device may produce highlight colors. Furthermore, any color along the line connecting the chromaticity coordinates of the two light-emitting subpixel elements may be created by altering the ratio of the luminance between the light-emitting elements.

The invention has been described in detail with particular reference to certain preferred embodiments thereof, but it will be understood that variations and modifications can be effected within the spirit and scope of the invention.

PARTS LIST

10 spectrum locus
12 Planckian locus
14*a* D50 white reference point
14*b* D65 white reference point
14*c* D93 white reference point
20 group of white points
22*a* 5000K white point
22*b* 6500K white point
22*c* 9300K white point
24 straight line fit
30 linear fit of Planckian locus
31 5000K blackbody radiator
32 9500K blackbody radiator
33 chromaticity coordinate of first light-emitting element
34 chromaticity coordinate of first light-emitting species
35 chromaticity coordinate of white color
36 chromaticity coordinate of second light-emitting species
37 connecting line in chromaticity space
38 chromaticity coordinate of second light-emitting element
39 connecting line in chromaticity space
40 control signal
41 controller
42*a* power supply
42*b* power supply
44*a* light-emitting diode
44*b* light-emitting diode
45 digital to analog converter
46*a* resistor

46*b* resistor
48*a* transistor
48*b* transistor
49*a* resistor
49*b* resistor
50 linear fit of Planckian locus
51 9500K blackbody radiator
52 5000K blackbody radiator
53 chromaticity coordinate of first light-emitting element
54 chromaticity coordinate of first light-emitting species
55 chromaticity coordinate of white color
56 chromaticity coordinate of second light-emitting species
57 connecting line in chromaticity space
58 chromaticity coordinate of second light-emitting element
59 connecting line in chromaticity space
60 inorganic light-emitting diode
62 inorganic light-emitting layer
63 quantum dots
64 substrate
66 anode
68 bus
69 cathode
70 process step: form first size distribution of quantum dots
72 process step: form second size distribution of quantum dots
74 process step: form mixture of two distributions
76 optional process step: form colloidal mixture of quantum dots with additional conductive inorganic particles
78 process step: deposit quantum dot mixture onto device
80 process step: form first electrode over substrate
82 process step: select emitters to form white point on Planckian locus
84 process step: form first light-emitting layer
86 process step: select emitters to form white point along projected line through first layer
88 process step: form second light-emitting layer
90 process step: form second electrode over light-emitting layer
92 process step: connect controller
94 optional process step: form intermediate electrode
100 display
104 pixel
106 sub-pixel element
108 sub-pixel element
110*a* control line
110*b* control line
112 light source
114 first light-emitting element
116 second light-emitting element
118 controller

What is claimed is:

1. A white-light area-emitting electroluminescent device having an adjustable color temperature substantially on a predetermined range of a Planckian locus within the 1976 Commission Internationale de l'Eclairage (CIE) uniform chromaticity scale, comprising:

a. only one first area light-emitting element having a fixed ratio of at least two different species of quantum dot emitters, mixed together and distributed over an area under common control, the radiant output of which produces a set of chromaticity coordinates at a predetermined white point substantially on the Planckian locus;

b. only one second area light-emitting element having at least a single species of quantum dot emitters distributed over an area, the radiant output of which produces a set of chromaticity coordinates positioned along a projected line extending from the Planckian locus and through the predetermined white point of the first light-emitting element; and c. a controller for adjusting the voltage or current associated with the first and second light-emitting elements to provide white light with a predetermined range of chromaticity coordinates substantially on the Planckian locus.

2. The white-light electroluminescent device of claim 1, wherein the two different species of quantum dot emitters provide complementary colors of yellow and blue light, and wherein the chromaticity coordinates of the complementary colors of light define the endpoints of a line in the CIE 1976 uniform chromaticity scale that intersects the Planckian locus within the interval $0.175 <= u' <= 0.225$.

3. The white-light electroluminescent device of claim 1, wherein the predetermined range of the Planckian locus corresponds to the range of blackbody radiators having a correlated color temperature range of 5000K to 9500K.

4. The white-light electroluminescent device of claim 2, wherein the light emitted by the second light-emitting element has a dominant wavelength between 475 nm and 480 nm.

5. The white-light electroluminescent device of claim 2, wherein the light emitted by the second light-emitting element has a dominant wavelength between 575 nm and 580 nm.

6. The white-light electroluminescent device of claim 1, wherein the species of quantum dot emitters are comprised of inorganic light-emitting particles.

7. The white-light electroluminescent device of claim 1, wherein the device is a general purpose lighting fixture.

8. The white-light electroluminescent device of claim 1, wherein the device is a display having an adjustable white point.

* * * * *